US010154767B2

(12) United States Patent
Ichikawa et al.

(10) Patent No.: US 10,154,767 B2
(45) Date of Patent: Dec. 18, 2018

(54) ELECTRIC VACUUM CLEANER

(71) Applicant: TOSHIBA LIFESTYLE PRODUCTS & SERVICES CORPORATION, Kawasaki-shi (JP)

(72) Inventors: Hiromitsu Ichikawa, Owariasahi (JP); Masatoshi Tanaka, Seto (JP); Atsushi Morishita, Hadano (JP); Hiromitsu Murata, Kasugai (JP); Yukio Machida, Owariasahi (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 0 days.

(21) Appl. No.: 15/305,000

(22) PCT Filed: Apr. 22, 2015

(86) PCT No.: PCT/JP2015/062268
§ 371 (c)(1),
(2) Date: Oct. 18, 2016

(87) PCT Pub. No.: WO2015/163375
PCT Pub. Date: Oct. 29, 2015

(65) Prior Publication Data

US 2017/0188767 A1 Jul. 6, 2017

(30) Foreign Application Priority Data

Apr. 22, 2014 (JP) ..... 2014-088363

(51) Int. Cl.
*A47L 9/04* (2006.01)
*A47L 9/00* (2006.01)
(Continued)

(52) U.S. Cl.
CPC ..... *A47L 9/0494* (2013.01); *A47L 9/009* (2013.01); *A47L 9/02* (2013.01); *A47L 9/04* (2013.01);
(Continued)

(58) Field of Classification Search
CPC ..... A47L 9/0494; A47L 9/009; A47L 9/0411; A47L 9/0477; A47L 9/2805;
(Continued)

(56) References Cited

U.S. PATENT DOCUMENTS 6,581,239 B1 * 6/2003 Dyson ..... A47L 5/34 15/340.3
7,200,892 B2 * 4/2007 Kim ..... A47L 5/34 15/319
(Continued)

FOREIGN PATENT DOCUMENTS

DE 20 2004 002 284 U1 8/2004
JP 5-88463 U 12/1993
(Continued)

OTHER PUBLICATIONS

International Search Report dated Jul. 21, 2015, in PCT/JP2015/062268 filed Apr. 22, 2015.

*Primary Examiner* — Dung Van Nguyen
(74) *Attorney, Agent, or Firm* — Oblon, McClelland, Maier & Neustadt, L.L.P.

(57) ABSTRACT

An electric vacuum cleaner includes a main body case, driving wheels, and a cleaning portion. The main body case includes an electric blower, and a dust collecting portion communicating with a suction side of the electric blower. The driving wheels allow the main body case to travel on the surface to be cleaned. The cleaning portion includes a main body portion, the suction port, and wheels. The main body portion with a bottom surface portion facing the surface to
(Continued)

be cleaned is located in a lower portion of the main body case and can move up and down. The suction port is provided on the bottom surface portion and communicates with the dust collecting portion. The wheels protrude downward from the bottom surface portion to contact the surface to be cleaned, thereby causing the main body portion to move up and down to trace the surface to be cleaned.

8 Claims, 8 Drawing Sheets

(51) Int. Cl.
*A47L 9/28* (2006.01)
*A47L 9/02* (2006.01)

(52) U.S. Cl.
CPC ..... *A47L 9/0411* (2013.01); *A47L 9/0477* (2013.01); *A47L 9/28* (2013.01); *A47L 9/2805* (2013.01); *A47L 9/2842* (2013.01); *A47L 9/2847* (2013.01); *A47L 9/2852* (2013.01); *A47L 9/2873* (2013.01); *A47L 9/2884* (2013.01); *A47L 9/2894* (2013.01); *A47L 2201/022* (2013.01); *A47L 2201/04* (2013.01); *A47L 2201/06* (2013.01)

(58) Field of Classification Search
CPC .... A47L 9/2842; A47L 9/2847; A47L 9/2852; A47L 9/2873; A47L 9/2884; A47L 9/2894; A47L 2201/022; A47L 2201/04; A47L 2201/06
See application file for complete search history.

(56) References Cited

U.S. PATENT DOCUMENTS

| | | | | |
|---|---|---|---|---|
| 7,246,405 | B2 | 7/2007 | Yan | |
| 2004/0074044 | A1* | 4/2004 | Diehl | A47L 5/22 15/412 |
| 2004/0255425 | A1* | 12/2004 | Arai | A47L 5/28 15/300.1 |
| 2005/0076466 | A1 | 4/2005 | Yan | |
| 2007/0113373 | A1* | 5/2007 | Hato | A47L 5/30 15/354 |
| 2007/0186522 | A1* | 8/2007 | Hato | A47L 9/1666 55/467 |
| 2008/0052867 | A1* | 3/2008 | Park | A47L 9/009 15/319 |

FOREIGN PATENT DOCUMENTS

| | | | |
|---|---|---|---|
| JP | 2002-532180 | A | 10/2002 |
| JP | 2002-366228 | A | 12/2002 |
| JP | 2004-180750 | A | 7/2004 |
| JP | 3104372 | U | 9/2004 |
| JP | 2007-325701 | A | 12/2007 |
| JP | 4781453 | B2 | 9/2011 |
| KR | 10-2006-0037665 | A | 5/2006 |
| TW | M 247170 | U | 10/2004 |

* cited by examiner

ELECTRIC VACUUM CLEANER

CROSS REFERENCE TO RELATED APPLICATIONS

The present application is a National Stage Application of PCT/JP2015/062268 filed on Apr. 22, 2015. The PCT application claims priority to Japanese Patent Application No. 2014-088363 filed on Apr. 22, 2014. All of the above applications are herein incorporated by reference in their entirety.

FIELD

The embodiments described herein relate generally to an electric vacuum cleaner having a main body case with a lower portion facing a surface to be cleaned, the lower portion including a suction port communicating with a dust collecting portion.

BACKGROUND

Conventionally, a so-called autonomously traveling electric vacuum cleaner (cleaning robot) is known which detects an obstacle and the like using, for example, a sensor and the like while autonomously traveling on and cleaning a surface to be cleaned. Such an electric vacuum cleaner is provided with a main body case having a dust collecting portion and the like. The main body case has a lower portion with a suction port being formed so as to communicate with the dust collecting portion and with a pair of driving wheels being mounted so as to cause the main body case to travel autonomously. Additionally, inside the main body case, an electric blower is housed having a suction side communicating with the dust collecting portion. The electric blower is then driven to suck dust with air via the suction port into the dust collecting portion for cleaning.

In the case of such an electric vacuum cleaner, it is desirable to secure a suction force with the suction port close to the surface to be cleaned since the magnitude of a degree of vacuum changes at the suction port according to the magnitude of a gap between the suction port and the surface to be cleaned, while it is also required to prevent grip force from being lowered when the suction port is close to the surface to be cleaned causing a part of the suction port to drive over and be stuck in irregularities and the like protruding from the surface to be cleaned, thereby lifting the driving wheels from the surface to be cleaned.

CITATION LIST

Patent Literature

PTL 1: Japanese Patent Publication No. 4781453

Technical Problem

It is an object of the present invention to provide an electric vacuum cleaner maintaining an approximately constant gap between a suction port and a surface to be cleaned, and reducing the chance that a cleaning portion drives over the surface to be cleaned while allowing a suction force to be secured.

Solution to Problem

An electric vacuum cleaner according to an embodiment of the present invention includes a main body case, driving wheels, and a cleaning portion. The main body case is provided with an electric blower, and a dust collecting portion communicating with a suction side of the electric blower. The driving wheels allow the main body case to travel on a surface to be cleaned. The cleaning portion is provided with a main body portion, a suction port, and a gap retaining member. The main body portion with a bottom surface portion facing the surface to be cleaned is located in a lower portion of the main body case and is capable of moving up and down. The suction port is provided on the bottom surface portion and communicates with a dust collecting portion. The gap retaining member protrudes downward from the bottom surface portion to contact the surface to be cleaned, thereby causing the main body portion to move up and down in such a way as to trace the surface to be cleaned.

DETAILED DESCRIPTION

Figure 1:
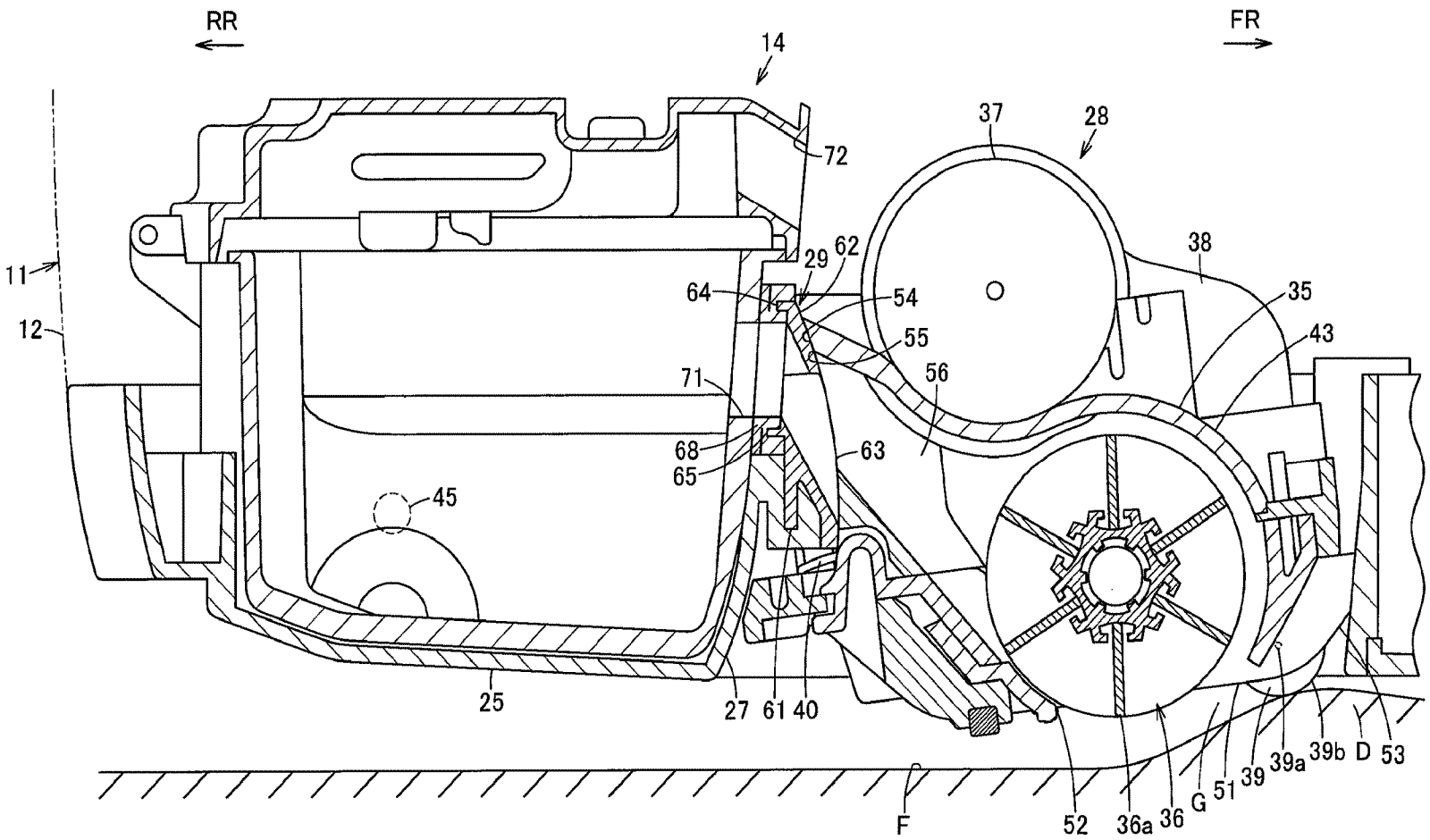
FIG. 1 is a cross-sectional view taken along relative position I-I in FIG. 5, showing a state where a cleaning portion of an electric vacuum cleaner according to one embodiment of the present invention is located relatively upward.

Hereinafter, description will be given for construction of one embodiment of the present invention with reference to FIGS. 1 to 10.

In FIGS. 1 to 10, a reference numeral 11 denotes an electric vacuum cleaner. In this embodiment, the electric vacuum cleaner 11 will be described below by giving an example of a so-called self-propelled robot cleaner for cleaning a surface to be cleaned (floor) F while autonomously traveling (being self-propelled) on the surface to be cleaned F.

The electric vacuum cleaner 11 includes a hollow main body case 12. This main body case 12 houses an electric blower 13, and has a dust collecting portion 14 communicating with a suction side of the electric blower 13, which is located in, for example, the rear and provided detachably. Further, the main body case 12 is provided with: driving wheels 15 as, for example, a plurality of (a pair of) drive portions; a plurality of follower wheels 17; range sensors 18 as a plurality of distance detection means (distance detection portions); side brushes 19, 19 which are revolving cleaning portions as a pair of cleaning portions; a control portion (control means) 22 composed of a circuit board and the like; and a secondary battery 23 which is a battery constituting a power supply portion, respectively. It is noted that hereinbelow, a direction along a travel direction of the electric vacuum cleaner 11 (main body case 12) is a fore-and-aft direction (directions of arrows FR and RR shown in FIG. 1, etc.), and a right-and-left direction (lateral direction) crossing (orthogonal to) the fore-and-aft direction is a width direction, on the basis of a state where the electric vacuum cleaner 11 is placed on a flat surface to be cleaned.

The main body case 12 is configured in a flattened columnar shape (disk shape) or the like by combining a plurality of case bodies formed of, for example, a rigid synthetic resin and the like. A lower surface 25 constituting a lower portion of the main body case 12 is formed in a circular shape in planar view. In the lower surface 25, a plurality of exhaust ports 26 for discharging exhaust air from the electric blower 13, and a mounting opening 27 are opened, respectively, while the driving wheels 15, 15 are arranged at positions nearer the front on both sides of the mounting opening 27. The mounting opening 27 is located in an approximately central part in a width direction and nearer the rear in a fore-and-aft direction in the main body case 12 (to the front of the dust collecting portion 14), and is formed longitudinally in the width direction, that is, in a horizontally long rectangular shape. Moreover, the mounting opening 27 is mounted with a cleaning portion 28 which is a suction portion movable vertically (capable of moving up and down) with respect to the main body case 12. Further, there is a communicating portion 29 between the cleaning portion 28 and the dust collecting portion 14 for communicating these cleaning portion 28 and dust collecting portion 14.

On the other hand, a top surface 31 constituting an upper portion of the main body case 12 is formed in a circular shape in planar view. On the top surface 31, a communications portion 33 for wireless communication with an external device is arranged in an approximately central part in the width direction of a front end. Additionally, the top surface 31 is provided with a dust collecting portion lid 34 which is opened and closed for attaching and detaching the dust collecting portion 14.

The cleaning portion 28 (FIGS. 1 to 6) is located so as to face the surface to be cleaned F in a state where the electric vacuum cleaner 11 is placed on the surface to be cleaned F, and is integrally provided with: a main body portion 35; a rotary brush 36 as a rotary cleaning body rotatably mounted to the main body portion 35; a brush motor 37 as a rotary drive means (rotary drive portion) mounted to the main body portion 35 to generate a rotary force for rotationally driving the rotary brush 36; a brush gear box 38 as a transmitting means (transmitting portion) mounted to the main body portion 35 to transmit the rotary force of the brush motor 37 to the rotary brush 36; and wheels 39, 39 which are rotators serving as gap retaining members (contact members) mounted to the main body portion 35. Further, the cleaning portion 28 is urged downward with respect to the main body case 12 by means of, for example, a pair of coil springs 40, 40 as an urging means (urging body).

The main body portion 35 is formed of, for example, a rigid synthetic resin and the like. The main body portion 35 is integrally provided with, for example, a pair of journal arms 42, 42 journalled in the main body case 12, and a case portion 43 fitted into the mounting opening 27.

The journal arms 42, 42 linearly extend rearward from positions near both sides of the case portion 43. At tip portions (rear end portions) of the journal arms 42, 42, that is, positions distanced rearward with respect to the case portion 43, columnar turning shafts 45, 45 are protrudingly disposed outward in the width direction. The turning shafts 45, 45 have an axial direction along a horizontal direction (width direction), respectively, and are located coaxially with each other. Further, these turning shafts 45, 45 are located on both sides of the dust collecting portion 14 and above the lower surface 25 in such a way as to be rotatably journalled with respect to the main body case 12. That is, these turning shafts 45, 45 allow the main body portion 35 (cleaning portion 28) to be rotatably journalled with respect to the main body case 12. The main body portion 35 (cleaning portion 28) turns around these turning shafts 45, 45 so that the main body portion 35 is movable up and down with respect to the main body case 12, that is to say, reciprocatingly movable from/to the lower surface 25 side to/from the surface to be cleaned F side (from/to a direction that protrudes from the lower surface 25 to/from the opposite direction (non-protruding direction)) between the lower surface 25 of the main body case 12 and the surface to be cleaned F. Therefore, the main body portion 35 is configured to be changed in the amount of protrusion downward (to the surface to be cleaned F side) from the lower surface 25 of the main body case 12 in accordance with turning.

On the other hand, a lower portion of the case portion 43 includes a bottom surface portion 51 which is a planar portion that faces the surface to be cleaned F, and in the bottom surface portion 51, a suction port 52 is opened. Additionally, the case portion 43 is provided with an inclined plane portion 53 which is a front face portion inclinatorily rising upward to the front from the front of the bottom surface portion 51. Moreover, the case portion 43 is provided with a slide contact surface portion 54 which is a rear face portion arcuately rising upward from the rear of the bottom surface portion 51, and in the slide contact surface portion 54, a communicating port 55 is opened. Further, the case portion 43 is provided with a duct portion 56 for communication between the suction port 52 and the communicating port 55.

The bottom surface portion 51 longitudinally extends in the width direction. Moreover, near both sides of the bottom surface portion 51, the wheels 39, 39 are rotatably mounted on a lateral side (outside) of the suction port 52. Further, the bottom surface portion 51 is located below from the lower surface 25, that is, protrudingly to the surface to be cleaned F side in a state where the main body portion 35 (cleaning portion 28) is located farthest below the main body case 12, so as to be approximately parallel to the lower surface 25. The bottom surface portion 51 may be located below the lower surface 25 in a state where the main body portion 35 (cleaning portion 28) turns upward with respect to the main body case 12, or may be located so as to be approximately flush with the lower surface 25 or so as to be at least partly above the lower surface 25.

The suction port 52 has a rectangular shape longitudinally extending in the width direction. In the suction port 52, the rotary brush 36 housed in the duct portion 56 is located, and a lower portion of an outer periphery side of the rotary brush 36 slightly protrudes downward from the suction port 52 so as to be allowed to contact the surface to be cleaned F. Further, the wheels 39, 39 are located to the front of the suction port 52, and at a rear position of the suction port 52, the main body portion 35 is rotatably journalled by the turning shafts 45, 45 with respect to the main body case 12.

The inclined plane portion 53 longitudinally extends in the width direction. A front side portion of the inclined plane portion 53 inclines toward a front edge of the mounting opening 27.

The slide contact surface portion 54 is a part in slide contact with the front of the communicating portion 29 from a rear edge of the mounting opening 27, facing the communicating portion 29, and longitudinally extends in the width direction. Moreover, the slide contact surface portion 54 is curved, when viewed laterally (from the right or left side) along a horizontal direction, in an arcuate shape along a turning direction of the main body portion 35 (cleaning portion 28), that is, curved along arcuation (arcuate surface) around the turning shafts 45, 45 (central axes of the turning shafts 45, 45). That is, the slide contact surface portion 54 is formed in a cylindrical surface shape having an axial direction along the horizontal direction (width direction). In other words, the slide contact surface portion 54 is formed coaxially with outer peripheral surfaces of the turning shafts 45, 45. Further, the slide contact surface portion 54 is curved so as to protrude gradually rearward facing upward.

The communicating port 55 is provided for communication between the suction port 52 and the dust collecting portion 14 (via the communicating portion 29), and has a rectangular shape longitudinally extending in the width direction. That is, the communicating port 55 is formed in a slit shape extending in the width direction.

The duct portion 56 is formed of, for example, a rigid synthetic resin and the like in a tubular shape so as to extend from a lower side to a rearward upward side, from the suction port 52 to the communicating port 55. Further, the inside of the duct portion 56 is a suction chamber through which the air including dust sucked from the suction port 52 passes to the dust collecting portion 14 side.

The rotary brush 36 longitudinally formed like a long shaft has a cleaning member 36*a* such as a bristle brush or a blade and the like being arranged on an outer peripheral surface, and rotates so that these cleaning members 36*a* are repeatedly brought into contact with the surface to be cleaned F, thereby scraping dust on the surface to be cleaned F. Further, both ends of the rotary brush 36 are located in the suction chamber so as to be journalled on both the right and left sides of the duct portion 56. That is, the rotary brush 36 has an axis of rotation along the horizontal direction (width direction).

The brush motor 37 is fixed on, for example, an outer surface of an upper portion of the duct portion 56. The brush motor 37 is located so as to be biased to one side in the width direction of the duct portion 56.

The brush gear box 38 is located on one side of the duct portion 56 and is fixed onto the main body portion 35 (case portion 43) so as to connect the brush motor 37 and the rotary brush 36 to each other.

The wheels 39, 39 are in contact with the surface to be cleaned F all the time to support the electric vacuum cleaner 11 (main body case 12), while allowing the main body portion 35 (cleaning portion 28) to move up and down (turn vertically) so as to trace the shape of the surface to be cleaned F. That is, the wheels 39, 39 retain an approximately constant gap G between the surface to be cleaned F and the bottom surface portion 51 (suction port 52), that is to say, maintain a predetermined gap G parallel between the bottom surface portion 51 (suction port 52) and the surface to be cleaned F. These wheels 39, 39 are located on the outside, that is, at an outer position of the suction port 52 in the width direction, and to the front of the suction port 52. The axes of rotation 39*a*, 39*a* as central axes of these wheels 39, 39 are located coaxially with each other along the horizontal direction (width direction). These axes of rotation 39*a*, 39*a* are journalled in the main body portion 35 (case portion 43) above the bottom surface portion 51 and at positions near the front end of the bottom surface portion 51, and journal support at such positions makes lower sides and front sides of outer peripheral surfaces of the wheels 39, 39 protrude downward and forward from the bottom surface portion 51. Thus, front side parts of the outer peripheral surfaces of the wheels 39, 39 protrude to a lower side forward from a corner having the bottom surface portion 51 and the inclined plane portion 53 continuously provided. Further, the outer peripheral surfaces of these wheels 39, 39 are covered by soft members (slide members) 39*b*, 39*b* such as a raised cloth or a nonwoven cloth having a higher sliding property, that is, higher slidability than that of the bottom surface portion 51 (main body portion 35).

The coil springs 40, 40 are arranged in the rear of both sides of the main body portion 35 (case portion 43), each having a lower end retained on the main body portion 35 (case portion 43) and an upper end retained by a spring receiving portion 58 as an urging means receiving portion (urging body receiving portion) provided in the main body case 12. These coil springs 40, 40 are located rearward of the suction port 52, and urge the main body portion 35 (case portion 43) downward at positions near base ends of the journal arms 42, 42.

The communicating portion 29 (FIGS. 1, 2, 5 and 7) is provided with a communicating portion main body 61 formed of, for example, a rigid synthetic resin and the like. The communicating portion main body 61 is formed longitudinally along the width direction. The communicating portion main body 61 is mounted to an upper portion of the lower surface 25 at a rear edge of the mounting opening 27, and is provided between the cleaning portion 28 and the dust collecting portion 14 to be fixed to the main body case 12. Moreover, the communicating portion main body 61 is provided with a curved surface portion 62 in a curved surface shape, capable of being in slide contact with the slide contact surface portion 54 of the cleaning portion 28 (main body portion 35), facing the cleaning portion 28. In the curved surface portion 62, a communicating opening 63 is opened. Further, the communicating portion main body 61 includes a planate interface portion 64 facing the dust collecting portion 14, and the interface portion 64 has an air vent opening 65 which is opened to communicate with the communicating opening 63. Therefore, the communicating portion main body 61 is formed in a tubular shape having an axial direction along the fore-and-aft direction.

The curved surface portion 62 is a part in slide contact with the slide contact surface portion 54, facing the rear of the main body portion 35 (case portion 43) of the cleaning portion 28, and longitudinally extends in the width direction. In the present embodiment, the curved surface portion 62 is directly in close slide contact with the slide contact surface portion 54 almost without clearance. Additionally, the curved surface portion 62 is curved, when viewed laterally (from the right or left side) along the horizontal direction, in an arcuate shape along a turning direction of the main body portion 35 (cleaning portion 28), that is, curved along arcuation (arcuate surface) around the turning shafts 45, 45 (central axes of the turning shafts 45, 45), so as to have curvature approximately the same as that of the slide contact surface portion 54. That is, the curved surface portion 62 is formed in a cylindrical surface shape having an axial direction along the horizontal direction (width direction). In other words, the curved surface portion 62 is formed coaxially with outer peripheral surfaces of the turning shafts 45, 45. Further, the curved surface portion 62 is curved so as to protrude gradually rearward facing upward. Moreover, the curved surface portion 62 is configured to keep slide contact with the slide contact surface portion 54 in the whole range in which the main body portion 35 (cleaning portion 28) moves up and down (turns vertically) with respect to the main body case 12.

The communicating opening 63 is formed in a rectangular shape longitudinally extending in the width direction. The communicating opening 63 is configured to communicate with the dust collecting portion 14 mounted to the main body case 12, via the air vent opening 65. Moreover, the communicating opening 63 communicates with the communicating port 55 opened in the slide contact surface portion 54 of the main body portion 35 (cleaning portion 28) in slide contact with the curved surface portion 62, and keeps communication with the communicating port 55 by slide contact of the curved surface portion 62 with the slide contact surface portion 54 in the whole range in which the main body portion 35 (cleaning portion 28) moves up and down (turns vertically) with respect to the main body case 12. Therefore, the communicating opening 63 communicates with the suction port 52 (suction chamber) all the time (via the communicating port 55).

The interface portion 64 longitudinally extends in the width direction, for example, and is formed approximately perpendicularly along a vertical direction. The interface portion 64 is mounted with a seal body 68 in the form of a rectangular frame along a periphery of the air vent opening 65, which is in pressure contact with the dust collecting portion 14 mounted to the main body case 12 to keep hermetically with the connected dust collecting portion 14. The seal body 68 is formed of a member of, for example, rubber and the like so as to be elastically deformable.

The air vent opening 65 is formed in a rectangular shape longitudinally extending in the width direction. The air vent opening 65 is formed in such a way as to be smoothly continued to the communicating opening 63 without irregularities.

The electric blower 13 is housed in the main body case 12 at a position, for example, between the driving wheels 15, 15. A suction side of the electric blower 13 is hermetically connected to the dust collecting portion 14 via a not shown communicating air trunk portion.

The dust collecting portion 14 (FIG. 7) is provided for accumulating in the inside dust sucked from the suction port 52 by drive of the electric blower 13, and in the present embodiment, is a dust collecting box detachable from the main body case 12. In the dust collecting portion 14 mounted to the main body case 12, opened are an introduction port 71 hermetically connected to the air vent opening 65 in pressure contact with a rear end portion of the seal body 68 of the communicating portion 29, and an outlet 72 hermetically connected to the communicating air trunk portion in a state where the dust collecting portion 14 is mounted to the main body case 12. The introduction port 71 is longitudinally opened in the width direction at a position on a front lower side facing the interface portion 64 of the communicating portion 29 (the air vent opening 65 and the seal body 68). Further, the outlet 72 is opened at a position on a front upper side facing the communicating air trunk portion, for example. That is, these introduction port 71 and outlet 72 are located to the front of the dust collecting portion 14, which is the same side as each other so as to be arranged side by side vertically. Dust accumulated in the dust collecting portion 14 can be discarded from the introduction port 71 or the outlet 72 after opening the dust collecting portion lid 34 to remove the dust collecting portion 14 from the main body case 12, however, in order to make dust easier to be discarded, a separate dust discard port may be provided in such a way as to allow opening and closing.

The driving wheels 15, 15 allow the main body case 12 to travel (autonomously travel) on the surface to be cleaned F, that is, are provided for travel. The driving wheels 15, 15 are formed in a disk shape having an axis of rotation along the horizontal direction (width direction), and are arranged at positions near the center of a fore-and-aft direction in a lower portion of the main body case 12 so as to be distanced from each other in the width direction. Further, these driving wheels 15, 15 are rotationally driven via motors 74, 74 (FIG. 8) as drive means (drive portions).

These motors 74, 74 are connected to the driving wheels 15, 15 respectively, via a not shown gear box as a drive transmission means (drive transmission portion), so as to allow the driving wheels 15, 15 to be driven independently. Further, these motors 74, 74, together with the driving wheels 15, 15 and each gear box, are integrally urged in a direction that protrudes downward from the lower surface 25 of the main body case 12 by means of a not shown suspending means (suspending portion (suspension)). Urging in this manner allows grip force of the driving wheels 15, 15 to be secured with respect to the surface to be cleaned F.

The follower wheels 17 (FIG. 9) are arranged at a position in the lower surface 25 of the main body case 12 in such a way as to be able to support together with the driving wheels 15, 15 the weight of the electric vacuum cleaner 11, so as to be balanced and freely rotate appropriately. Particularly, the follower wheels 17 at a position in an approximately center of the width direction and the front of the lower surface 25 in the main body case 12 are provided as revolving wheels 77 mounted to the lower surface 25 so as to be capable of revolving parallel to the surface to be cleaned F.

The range sensor 18 is a non-contact type sensor such as, for example, an ultrasonic sensor or an infrared sensor and the like. The range sensor 18 is arranged over the front of an outer periphery and both sides of the main body case 12, for example, and is capable of detecting the presence or absence of an obstacle (wall portion) and the like to the front and to the side of the main body case 12, the distance between such obstacles and the main body case 12, and the like, respectively.

The side brushes 19, 19 are provided for scraping together and cleaning dust at a position outside a profile (outer peripheral surface) of the main body case 12 or to the front of the driving wheels 15, 15, such as on both sides of the suction port 52, particularly near the wall, to which the suction port 52 is inaccessible. The side brushes 19, 19 are arranged at positions of, for example, both sides in the width direction of the main body case 12, which are, in the present embodiment, positions diagonally forward on both sides with respect to the center of the fore-and-aft direction in the main body case 12 (forward and right and left at 45 degrees of the main body case 12). These side brushes 19, 19 each includes: a brush main body 81 as a cleaning portion main body movable radially along a radial direction of the main body case 12; a not shown brush urging means (brush urging body) as a cleaning portion urging means (cleaning portion urging body) for urging the brush main body 81 in a direction that protrudes from the profile (outer peripheral surface) of the main body case 12; a cleaning body 83 such as a bristle brush and the like being rotatably arranged in a lower portion of the brush main body 81, facing the surface to be cleaned F; and a revolving motor 84 (FIG. 8) as a revolving drive means (revolving drive portion) for rotating the cleaning body 83.

The brush main body 81 is configured to be movable between a position that protrudes outward from the profile (outer peripheral surface) of the main body case 12 and a position that is approximately flush with the profile. Further, the brush main body 81 is configured to be brought into contact with an obstacle and the like and thereby retract to the main body case 12 side against urging by the brush urging means (brush urging body).

The revolving motor 84 is integrally mounted to the brush main body 81, and configured to rotate, that is, revolve the cleaning body 83 parallel to the surface to be cleaned F. In the present embodiment, the revolving motors 84, 84 revolve the cleaning bodies 83, 83 facing each other, in such a way as to scrape together dust on both sides of the main body case 12 to a center side in the width direction of the main body case 12. That is, the revolving motor 84 of the side brush 19 located on the left side is configured to revolve the cleaning body 83 clockwise (to the right), while the revolving motor 84 of the side brush 19 located on the right side is configured to revolve the cleaning body 83 counter-clockwise (to the left).

Further, the control portion 22 is provided with, for example, a timing means (timing portion) such as a timer, a storage means (storage portion) such as memory, and a control portion main body such as a microcomputer. The control portion 22 is electrically connected to the electric blower 13, the range sensor 18, the communications portion 33, the brush motor 37, the motors 74, 74, the revolving motors 84, 84, and the like. Based on a detection result by the range sensor 18, the control portion 22 controls drive of the driving wheels 15, 15 via the motors 74, 74 to allow the main body case 12 (electric vacuum cleaner 11) to autonomously travel in such a way as to avoid an obstacle, while controlling drive of the electric blower 13, the brush motor 37 and the revolving motors 84, 84 to allow the electric vacuum cleaner 11 to clean.

The secondary battery 23 (FIG. 8) is provided for supplying power to the control portion 22, the electric blower 13, the range sensor 18, the brush motor 37, the motors 74, 74, the revolving motors 84, 84, and the like. The secondary battery 23 is arranged at a position between the driving wheels 15, 15 rearward to the revolving wheel 77, for example. Further, the secondary battery 23 is electrically connected to a charging terminal located on the lower surface 25 of the main body case 12, so as to be chargeable through the charging terminal connected to a not shown predetermined charging stand installed at a predetermined position, for example, indoors (in a room) and the like.

Next, description will be given for operation of the above-described embodiment.

When the electric vacuum cleaner 11 is placed on the surface to be cleaned F, the driving wheels 15, 15 come into contact with the surface to be cleaned F so that the electric vacuum cleaner 11's own weight causes the driving wheels 15, 15, together with each gear box, to sink into a position inside the main body case 12 where the follower wheel 17 (revolving wheel 77) comes into contact with the surface to be cleaned F, against urging by the springing means (springing portion). In the case of the cleaning portion 28 being in such a state, an outer peripheral surface (soft member 39*b*) of each wheel 39 comes into contact with the surface to be cleaned F, so that a predetermined gap G is formed between the surface to be cleaned F and the bottom surface portion 51, that is, between the suction port 52 and the surface to be cleaned F (FIGS. 1 to 4). Further, at a predetermined time preset or the like in the control portion 22, for example, the electric vacuum cleaner 11 drives the electric blower 13 to start cleaning from the charging stand, for example. A start position of cleaning is able to be set in any place such as a travel start position of the electric vacuum cleaner 11 or an entrance of a room and the like.

Figure 2:
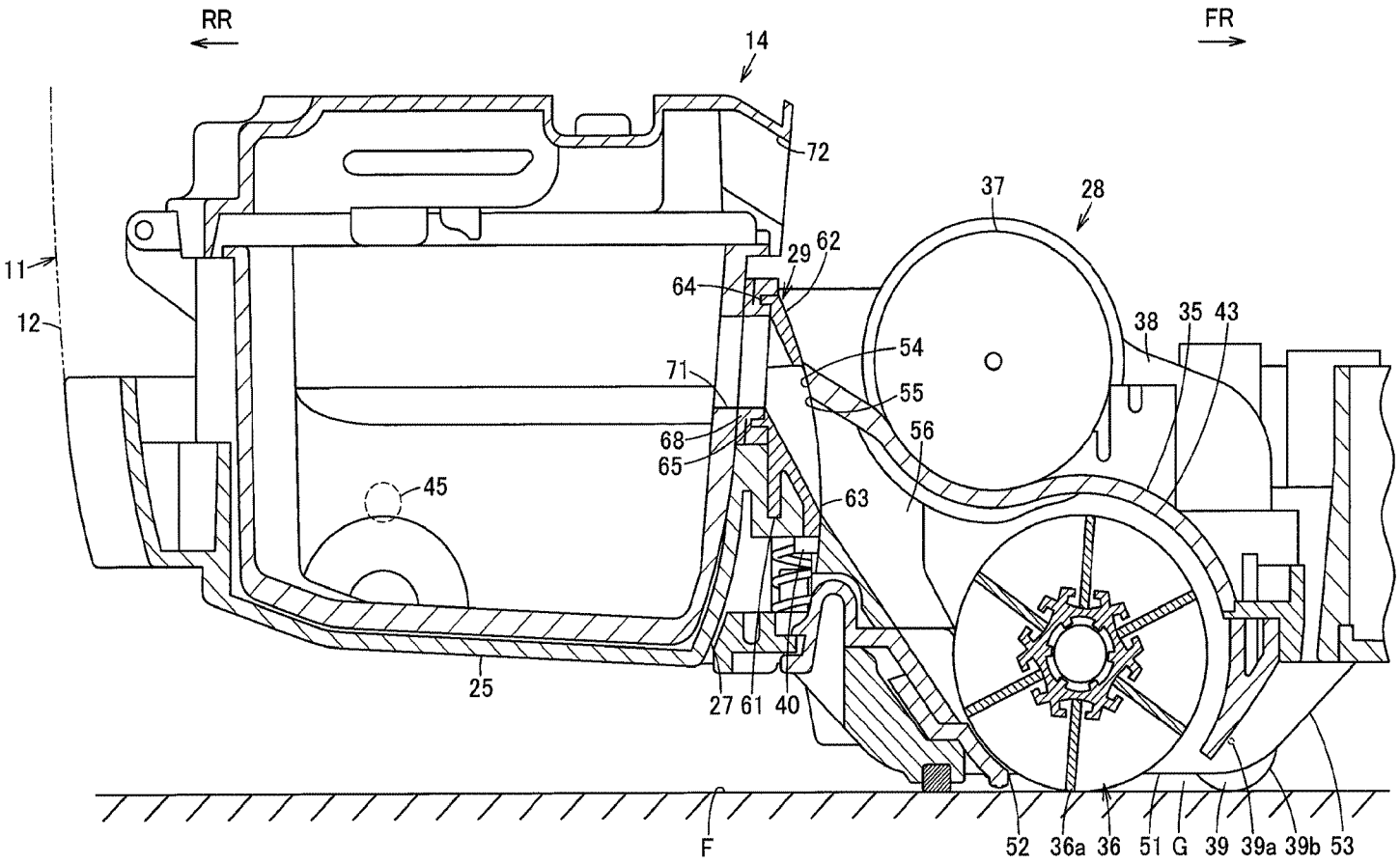
FIG. 2 is a cross-sectional view taken along relative position I-I in FIG. 5, showing a state where the same cleaning portion is located relatively downward.
Figure 3:
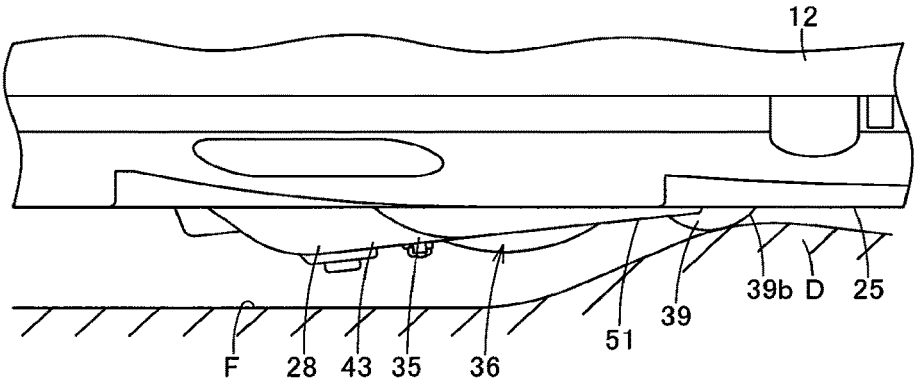
FIG. 3 is a side view showing a state where the same cleaning portion is located relatively upward.
Figure 4:
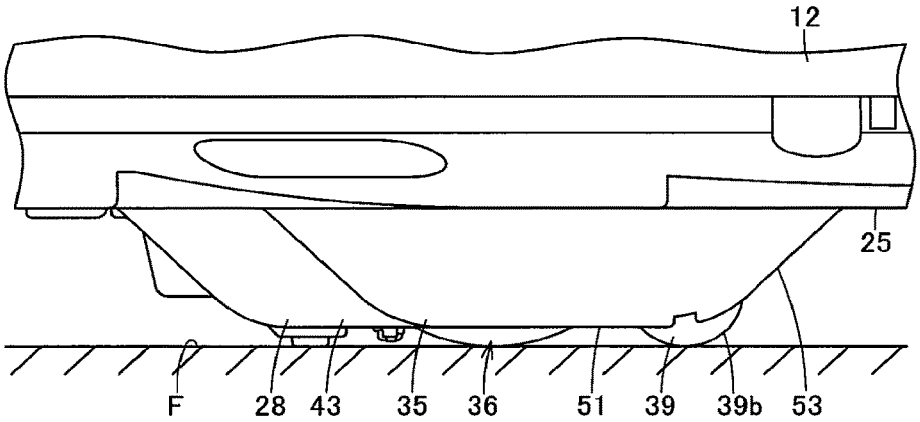
FIG. 4 is a side view showing a state where the same cleaning portion is located relatively downward.
Figure 5:
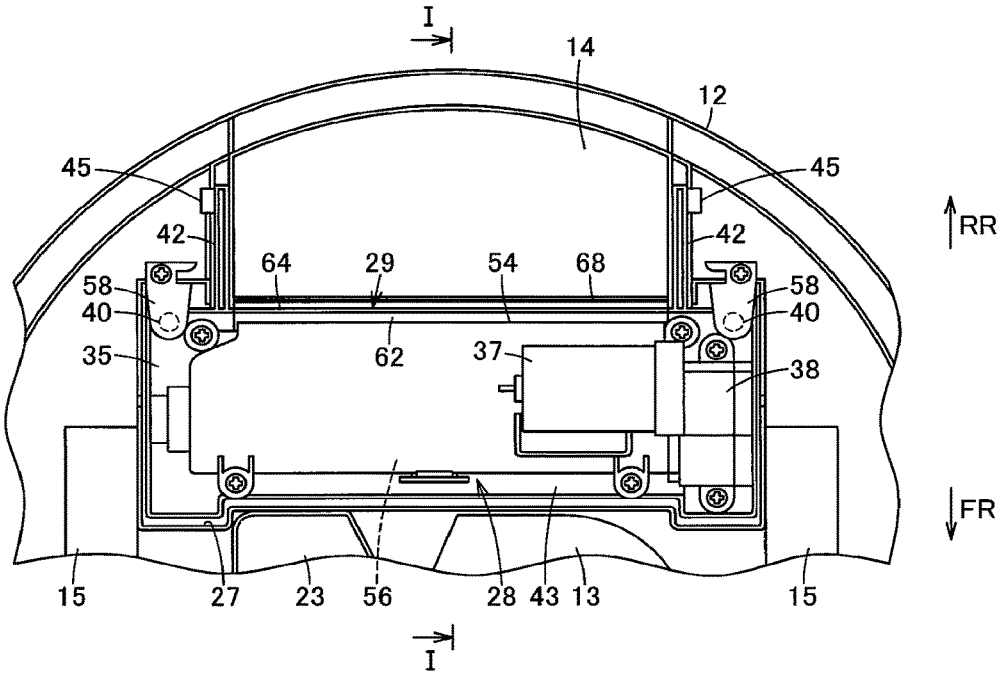
FIG. 5 is a plan view schematically showing a part of the inside of a main body case of the same electric vacuum cleaner.
Figure 6:
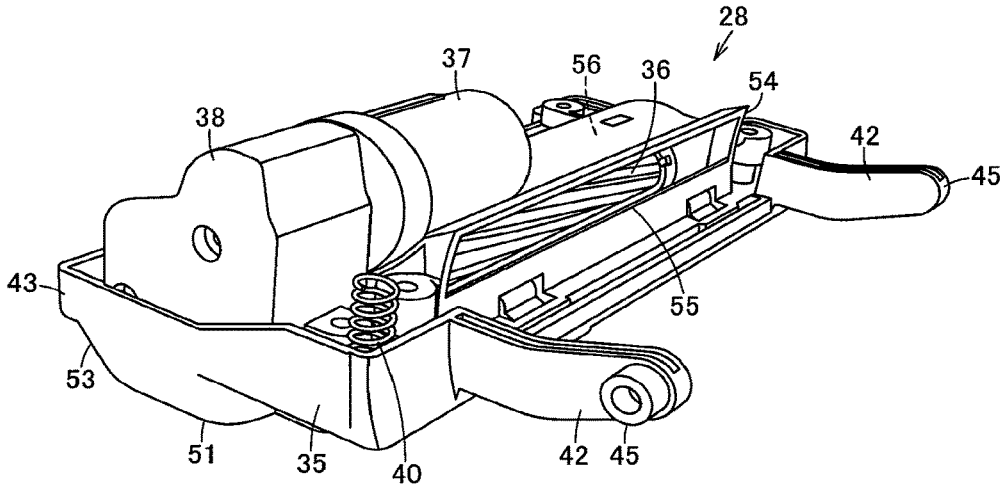
FIG. 6 is a perspective view showing the cleaning portion of the same electric vacuum cleaner.
Figure 7:
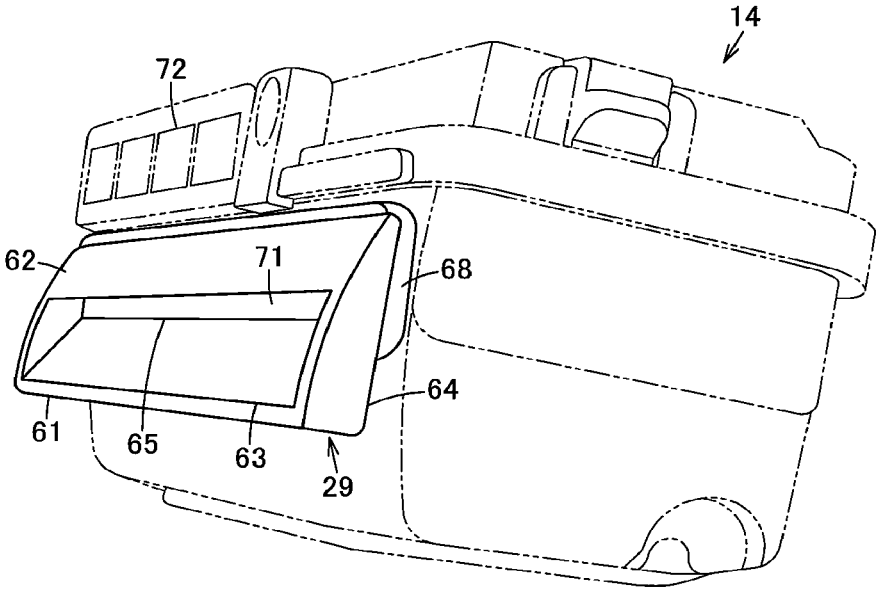
FIG. 7 is a perspective view showing a communicating portion of the same electric vacuum cleaner.
Figure 8:
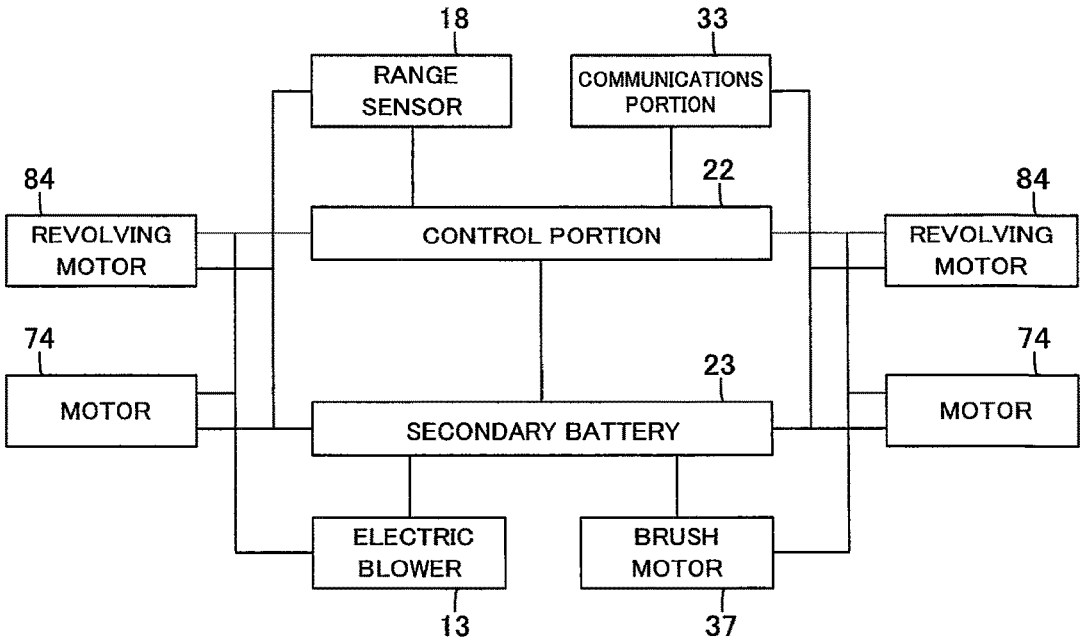
FIG. 8 is a block diagram showing an internal structure of the same electric vacuum cleaner.
Figure 9:
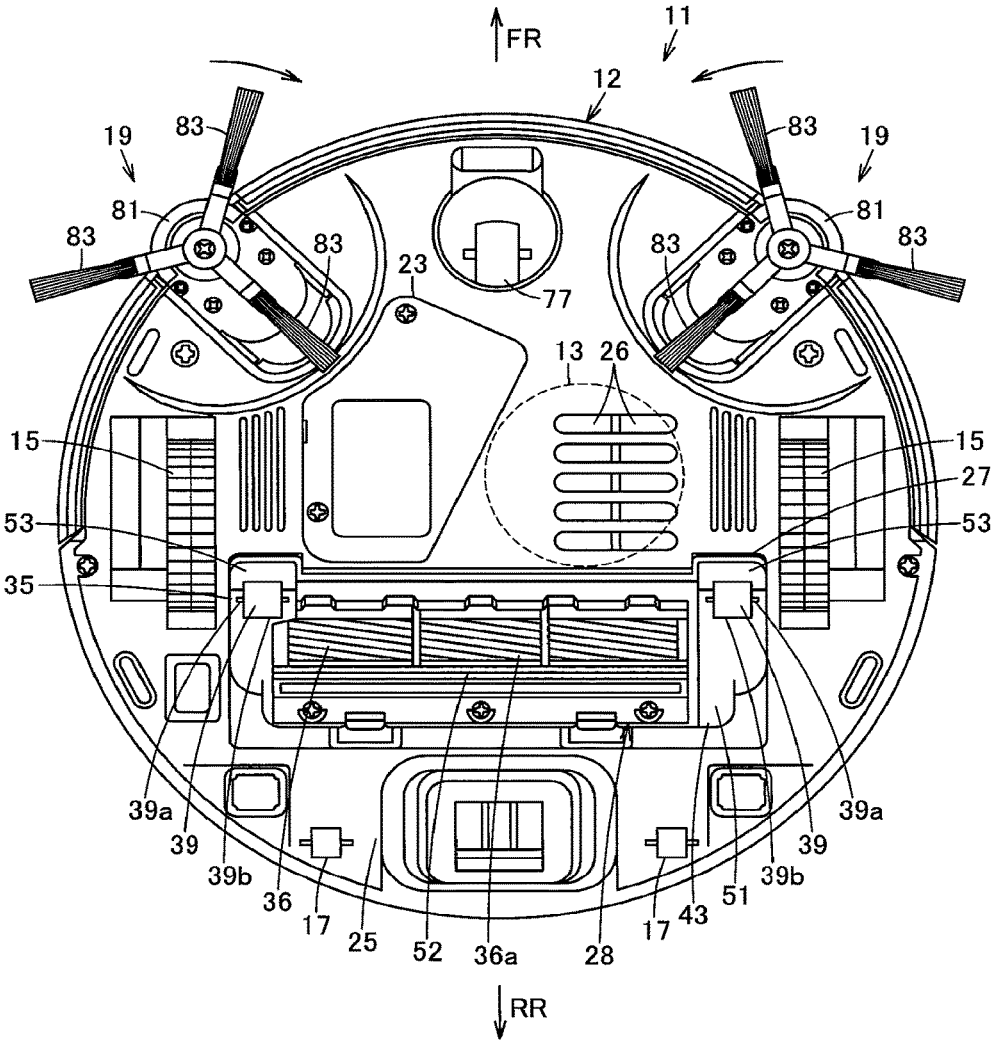
FIG. 9 is a plan view showing the same electric vacuum cleaner from below.
Figure 10:
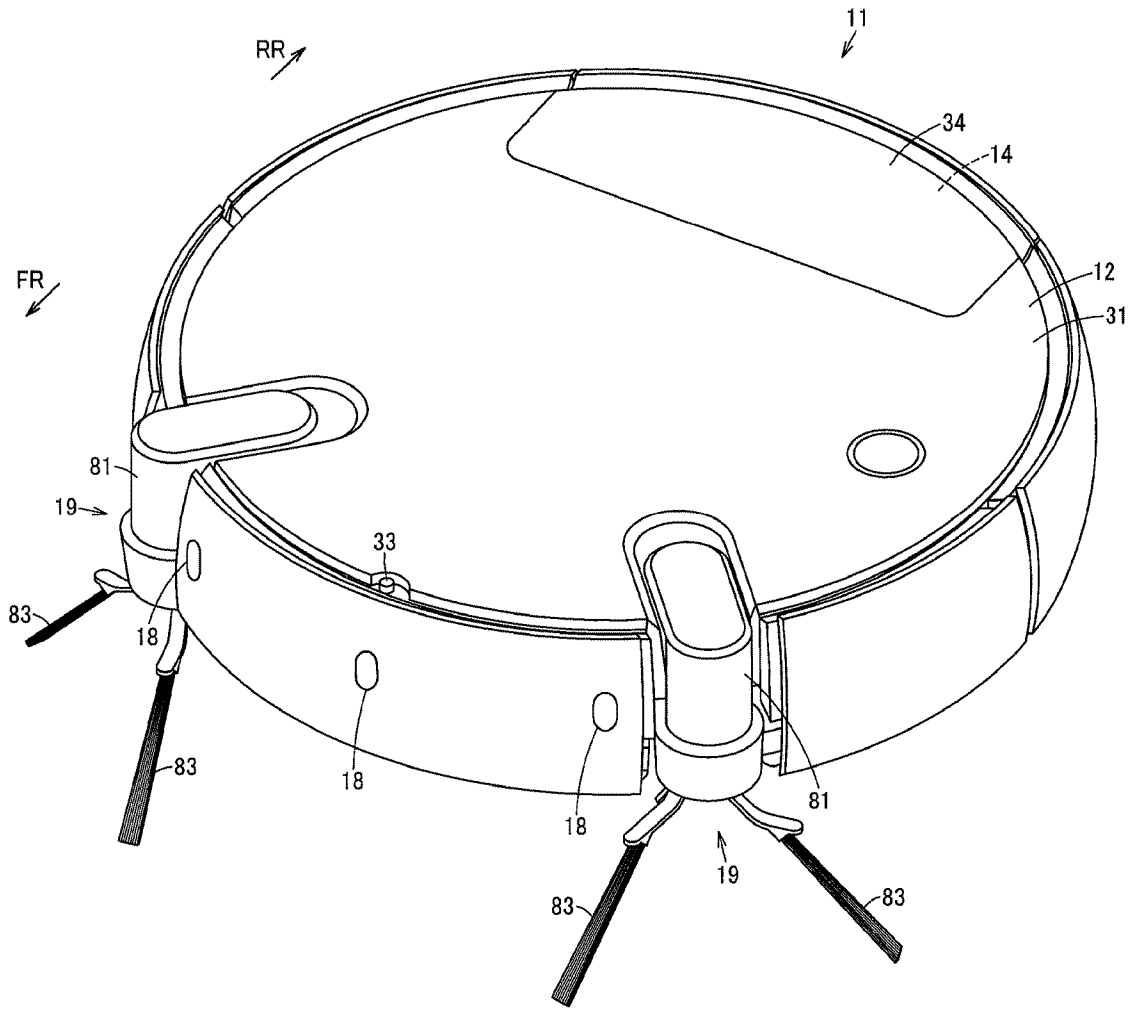
FIG. 10 is a perspective view showing the same electric vacuum cleaner.

In the electric vacuum cleaner 11, the control portion 22 drives the electric blower 13, while the motors 74, 74 detect, via the range sensor 18, distances, for example, to a wall portion surrounding a cleaning region, to an obstacle and the like in the cleaning region, thereby monitoring a position and a travel state of the electric vacuum cleaner 11. The electric vacuum cleaner 11 responds to detection by the range sensor 18 to travel on the surface to be cleaned F while avoiding an obstacle. At the time, in the cleaning portion 28, the main body portion 35 is urged downward while keeping the outer peripheral surface (soft member 39*b*) of each wheel 39 being in contact with the surface to be cleaned F, so that even in the case of having irregularities (concavity and convexity) D on the surface to be cleaned F, the main body portion 35 moves up and down in such a way as to trace the irregularities D while maintaining the gap G between the bottom surface portion 51 (suction port 52) and the surface to be cleaned F (FIGS. 1 to 4). Additionally, even when the main body portion 35 of the cleaning portion 28 moves up and down, the slide contact surface portion 54 is in slide contact with the curved surface portion 62 almost without clearance to keep communication of the communicating port 55 with the communicating opening 63, thereby keeping communication between the suction port 52 communicating with the communicating port 55 via the duct portion 56 and the dust collecting portion 14 communicating with the communicating opening 63 via the air vent opening 65 and the introduction port 71 (FIGS. 1 and 2). Further, an area in which the communicating port 55 and the communicating opening 63 communicate with each other is kept so as to be greater than an opening area of the introduction port 71 (air vent opening 65) in the dust collecting portion 14. That is, because width dimensions between the communicating port 55 and the communicating opening 63, and the introduction port 71 (air vent opening 65) are approximately equal to each other, a distance between a lower edge of the communicating port 55 and an upper edge of the communicating opening 63 when the main body portion 35 of the cleaning portion 28 moves up and down is kept so as to be greater than a vertical dimension of the introduction port 71 (air vent opening 65). The side brushes 19, 19 and the rotary brush 36 may be operated all the time as with the electric blower 13, or may be operated only as needed.

The electric vacuum cleaner 11 then sucks together with air, through the suction port 52 applied with negative pressure generated by drive of the electric blower 13, dust on the surface to be cleaned F facing the suction port 52 or dust scraped together by the side brushes 19, 19. The suction port 52 has the gap G from the surface to be cleaned F retained approximately constant by the wheels 39, 39, and thus keeps an approximately constant degree of vacuum so as to have a suction force retainable approximately constant. Further, the rotary brush 36 scrapes dust off the surface to be cleaned F through the suction port 52.

Dust sucked from the suction port 52 or dust scraped into the suction port 52 is introduced and collected from the introduction port 71 to the dust collecting portion 14, via the duct portion 56 (suction chamber), the communicating port 55, the communicating opening 63 and the air vent opening 65, while the air separated from the dust is sucked into the electric blower 13 via the outlet 72 and the communicating air trunk portion to cool down the electric blower 13, and thereafter is discharged as exhaust air from the exhaust ports 26 to the outside of the main body case 12.

In the case of determining that cleaning of a cleaning region is finished, the control portion 22 causes the electric vacuum cleaner 11 to autonomously travel to the position of the charging stand to stop the electric blower 13 and the like, while causing the charging terminal to (physically and electrically) connect to the charging stand to stop the motors 74, 74 in order to finish operation to charge the secondary battery 23.

According to one embodiment described above, the main body portion 35 of the cleaning portion 28 located in a lower portion of the main body case 12 is allowed to move up and down, and the suction port 52 communicating with the dust collecting portion 14 is provided on the bottom surface portion 51 of the main body portion 35, facing the surface to be cleaned F, while having the wheels 39, 39 protruding downward from the bottom surface portion 51 so as to bring the wheels 39, 39 into contact with the surface to be cleaned F, thereby causing the main body portion 35 to move up and down in such a way as to trace the surface to be cleaned F. Therefore, even in the case of having concavity and convexity such as irregularities D and the like on the surface to be cleaned F, it is possible to maintain an approximately constant gap G between the surface to be cleaned F, and the bottom surface portion 51 and the suction port 52 opened on the bottom surface portion 51. As a result, there is reduced chance that the cleaning portion 28 drives over (is stuck on) the surface to be cleaned F, while making it possible to maintain approximately constant magnitude of a degree of vacuum at the suction port 52, which changes according to the magnitude of the gap G between the suction port 52 and the surface to be cleaned F as well as allowing a suction force to be secured. That is, since the greater the gap G between the suction port 52 and the surface to be cleaned F, the lower the degree of vacuum at the suction port 52, thereby lowering the suction force, the gap G is provided approximately constant regardless of concave and convex shapes of the surface to be cleaned F, thereby making it possible to secure the degree of vacuum capable of keeping a suction force at the suction port 52.

Further, it is possible to prevent the bottom surface portion 51 of the main body portion 35 of the cleaning portion 28 and the like from driving over and being stuck in the irregularities D and the like on the surface to be cleaned F, thereby lowering grip force of the driving wheels 15, 15 with respect to the surface to be cleaned F, while making it possible also to securely prevent idle running of the driving wheels 15, 15 due to such lowered grip force, or a stuck state of the electric vacuum cleaner 11 (main body case 12) due to such idle running, and the like.

Further, surfaces of the wheels 39, 39, that is, outer peripheral surfaces in contact with the surface to be cleaned F are covered by soft members 39*b*, 39*b* having a sliding property higher than that of the bottom surface portion 51, thereby making it possible to prevent sliding resistance of the wheels 39, 39 with respect to the surface to be cleaned F, so as to further reduce the chance that the wheels 39, 39 are stuck in the surface to be cleaned F.

Further, the main body portion 35 of the cleaning portion 28 is mounted with the rotary brush 36, the brush motor 37 and the brush gear box 38 for rendering the main body portion 35 pressed downward all the time by the weight of the rotary brush 36, brush motor 37 and brush gear box 38 (and the main body portion 35's own weight). Thus, the wheels 39, 39 are pressed against the surface to be cleaned F all the time in order to make it difficult to be separated from the surface to be cleaned F, so that the wheels 39, 39 can allow an approximately constant gap G between the suction port 52 and the surface to be cleaned F to be maintained more securely.

The main body portion 35 of the cleaning portion 28 is then urged downward by the coil springs 40, 40, thereby making it possible to press the wheels 39, 39 more securely against the surface to be cleaned F in order to make it difficult to be separated from the surface to be cleaned F, while the wheels 39, 39 allow an approximately constant gap G between the suction port 52 and the surface to be cleaned F to be maintained more securely.

Moreover, the main body portion 35 is journalled so as to be turnable with respect to the main body case 12 at a rear position of the suction port 52, while arranging the wheels 39, 39 at a front position of the suction port 52 in the main body portion 35, so that when the electric vacuum cleaner 11 (main body case 12) advances, in the cleaning portion 28, the wheels 39, 39 first come into contact with the irregularities D approaching from the front of the electric vacuum cleaner 11 (main body case 12). Such contact allows the main body portion 35 to securely turn upward along the irregularities D so as to further reduce the chance that the main body portion 35 is stuck in the irregularities D.

Additionally, in the electric vacuum cleaner 11, the electric blower 13, the driving wheels 15, 15, the side brushes 19, 19, the control portion 22, the secondary battery 23, the motors 74, 74, and the like are located to the front of the suction port 52 of the main body case 12, thereby making it difficult to make room. Therefore, the main body portion 35 is journalled so as to be turnable rearward of the suction port 52, so that it is easy to make room for such journal and it is possible to separate a position where the main body portion 35 is journalled (positions of the turning shafts 45, 45) from the suction port 52. Thus, it is possible to practically configure the main body portion 35 in such a way as to move along a vertical direction with respect to the lower surface 25 of the main body case 12, so that regardless of positions to which the main body portion 35 moves up and down, it is possible to maintain the bottom surface portion 51, that is, the suction port 52 approximately parallel to the surface to be cleaned F, while allowing the gap G between the suction port 52 and the surface to be cleaned F to be maintained approximately constant.

Particularly, by utilizing the wheels 39, 39 which are rotators as gap retaining members, axes of rotation of the wheels 39, 39 are journalled in the main body portion 35 at positions above the bottom surface portion 51 of the main body portion 35, and at such positions that a part of an outer periphery of a front side of the wheels 39, 39 protrudes forward from the bottom surface portion 51. Thereby, when the electric vacuum cleaner 11 (main body case 12) advances, the wheels 39, 39 brought into contact with the irregularities D approaching from the front of the electric vacuum cleaner 11 (main body case 12) rotate so as to make it difficult to be stuck in the irregularities D. Further, since it becomes easy to sink the irregularities D downward along the outer peripheral surface (soft members 39*b*, 39*b*) of the wheels 39, 39, an orientation of force applying relatively rearward with respect to the wheels 39, 39 by contact of the wheels 39, 39 with the irregularities D can be effectively transformed by the wheels 39, 39 to a force applied upward, and such a force is utilized to allow the main body portion 35 to retract upward more effectively.

In the above-described embodiment, the slide contact surface portion 54 is configured to directly come into slide contact with the curved surface portion 62, however, may be configured in such a way that a seal member such as seal packing mounted to a position around the communicating port 55, for example, is in slide contact with the curved surface portion 62. That is, what is meant by the slide contact surface portion 54 being in slide contact with the curved surface portion 62 includes a configuration in which members arranged at least either in the slide contact surface portion 54 or curved surface portion 62 are in slide contact with each other.

Furthermore, as the gap retaining members (contact members), in place of the wheels 39, 39 (rotator), a simple projection capable of coming into contact with the surface to be cleaned F may be provided.

Moreover, the main body portion 35 (cleaning portion 28) is configured to be journalled so as to turn with respect to the main body case 12 and thereby movable up and down, however, may be configured to be provided with, for example, a guide and the like in such a way as to movably (slidably) guide the main body portion 35 (cleaning portion 28) vertically with respect to the main body case 12.

Additionally, as an urging body, in place of the coil springs 40, 40, torsion springs or the like for urging the turning shafts 45, 45 in a turning direction may be employed. Also, the main body portion 35 (cleaning portion 28) may be configured to turn and move downward by the weight of the rotary brush 36, the brush motor 37 and the brush gear box 38, as well as the weight of the main body portion 35 (case portion 43), without employing the urging body.

Moreover, the main body case 12 may have an outer peripheral surface provided with a contact type obstacle sensor or the like which comes into contact with, for example, an obstacle to detect the obstacle.

Further, the electric vacuum cleaner 11 is provided as a self-propelling type which autonomously travels while detecting an obstacle by means of the range sensor 18 and the like, however, may be configured to be remotely operated by a user with the use of a remote control and the like, for example.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An electric vacuum cleaner comprising:

a main body case including an electric blower, and a dust collecting portion communicating with a suction side of the electric blower;

a driving wheel allowing the main body case to travel on a surface to be cleaned;

a cleaning portion including:

a main body portion with a bottom surface portion facing the surface to be cleaned, the main body portion being located in a lower portion of the main body case and being rotatably journalled with respect to the main body case so as to be movable up and down, a suction port provided on the bottom surface portion being configured to communicate with the dust collecting portion, and a gap retaining member configured to protrude downward from the bottom surface portion to contact the surface to be cleaned, thereby causing the main body portion to move up and down with respect to the main body case in such a way as to trace the surface to be cleaned; and a range sensor detecting distance to an obstacle, wherein the range sensor, the gap retaining member, the suction port and a position where the main body portion is journalled to the main body case are arranged in this order in a travel direction of the main body case.

2. The electric vacuum cleaner according to claim 1, wherein the gap retaining member includes on its surface a soft member with a sliding property higher than that of the bottom surface portion.

3. The electric vacuum cleaner according to claim 1, wherein the cleaning portion includes:

a rotary drive portion mounted to the main body portion;

a transmitting portion mounted to the main body portion to transmit a rotary force of the rotary drive portion; and a rotary cleaning body rotatably mounted to the main body portion and located in the suction port, the rotary cleaning body being configured to rotate by the rotary force of the rotary drive portion transmitted from the transmitting portion so as to remove dust on the surface to be cleaned.

4. The electric vacuum cleaner according to claim 1, comprising an urging body configured to urge the main body portion toward the surface to be cleaned.

5. The electric vacuum cleaner according to claim 1, wherein the gap retaining member is a rotator, an axis of rotation of which is journalled in the main body portion at a position above the bottom surface portion of the main body portion, and at such a position that a part of an outer periphery of a front side in the gap retaining member protrudes forward from the bottom surface portion.

6. The electric vacuum cleaner according to claim 1, wherein the main body portion is rotatably journalled with respect to the main body case.

7. The electric vacuum cleaner according to claim 6, wherein the main body portion includes a pair of journal arms journalled in the main body case.

8. An electric vacuum cleaner comprising:

a main body case including an electric blower, and a dust collecting portion communicating with a suction side of the electric blower;

a driving wheel allowing the main body case to travel on a surface to be cleaned;

a cleaning portion including:

a main body portion with a bottom surface portion facing the surface to be cleaned, the main body portion being located in a lower portion of the main body case and being rotatably journalled with respect to the main body case so as to be movable up and down, a suction port provided on the bottom surface portion being configured to communicate with the dust collecting portion, and a gap retaining member configured to protrude downward from the bottom surface portion to contact the surface to be cleaned, thereby causing the main body portion to move up and down with respect to the main body case in such a way as to trace the surface to be cleaned; and a range sensor detecting distance to an obstacle and located proximate to a foremost position of the cleaner as the cleaner is moving in a traveling direction, wherein the gap retaining member, the suction port and a position where the main body portion is journalled to the main body case are arranged in an order of nearest to farthest relative to the range sensor.

* * * * *